United States Patent [19]

Ochi

[11] 4,097,688

[45] Jun. 27, 1978

[54] STEREOPHONIC REPRODUCING SYSTEM

[75] Inventor: Yoshiaki Ochi, Osaka, Japan

[73] Assignee: Matsushita Electric Industrial Co., Ltd., Osaka, Japan

[21] Appl. No.: 195,399

[22] Filed: Nov. 3, 1971

[30] Foreign Application Priority Data

Nov. 16, 1970 Japan ..... 45-101767
Nov. 18, 1970 Japan ..... 45-102278

[51] Int. Cl.[2] ..... H04R 5/00
[52] U.S. Cl. ..... 179/1 GQ; 179/100.4 ST
[58] Field of Search ..... 179/1 G, 1 GQ, 100.4 ST, 179/100.1 TD, 15 BT

[56] References Cited

U.S. PATENT DOCUMENTS

| | | | |
|---|---|---|---|
| 3,417,203 | 12/1968 | Hafler | 179/1 G |
| 3,478,167 | 11/1969 | Sorkin | 179/1 G |
| 3,588,355 | 6/1971 | Holm | 179/1 B |
| 3,637,938 | 1/1972 | Kuhlow | 179/1 G |
| 3,697,692 | 10/1972 | Hafler | 179/1 GQ |

OTHER PUBLICATIONS

4 Channels & Compatibility by Scheibes, Audio Engineering Society Preprint, Oct. 1970.

A New Quadraphonic System by Hafler, Audio Magazine, Jul. 1970.

*Primary Examiner*—Douglas W. Olms
*Attorney, Agent, or Firm*—Stevens, Davis, Miller & Mosher

[57] ABSTRACT

A stereophonic reproducing system having left signal and right signal channels and impedance provided between the two channels, whereby steady acoustic effects of 4-channel stereo may be simply obtained from 2-channel stereophonic signals.

1 Claim, 6 Drawing Figures

STEREOPHONIC REPRODUCING SYSTEM

This invention relates to stereophonic reproducing systems.

4-channel stereo systems using four speakers which are arranged respectively on the front left, front right, back left and back right of the listener for obtaining the same acoustic effects as if he were listening to actual performance are recently becoming increasingly popular.

Among the 4-channel stereo systems, so-called discrete systems in which 4 discrete sounds are independently reproduced are regarded as being superior, because they are most effective in stimulating the restorative sensation of attendance. In these systems, however, four amplifiers are required to amplify the four discrete signals, which leads to a large size of the overall unit and very high cost.

An object of the invention is to provide a stereophonic reproducing system, which provides practically the same acoustic restorative effects of the 4-channel stereo without using four amplifiers as mentioned above but with the usual 2-channel stereophonic amplifiers.

Another object of the invention is to simply and steadily obtain 4-channel stereophonic effects by making use of an impedance inserted between the two signal channels.

In order for the invention to be fully understood, it will now be described in conjunction with some embodiments thereof with reference to the accompanying drawing, in which.

Figure 1:
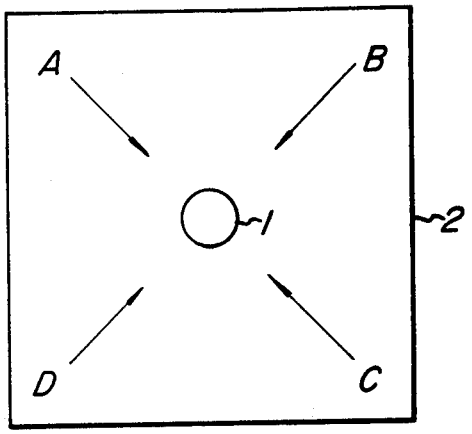
FIG. 1 is a representation of the status of collecting sounds reproduced by the stereophonic reproducing system according to the invention.

FIG. 1 represents the status of collecting sounds reproduced by the stereophonic reproducing system according to the invention. In the Figure, the sound collecting or listening spot is designated at 1. Where the sound collecting spot is at the center of room 2, as shown in FIG. 1, the sounds to be collected come to the spot from all the directions. It is now assumed that sounds to be collected come from four spots A, B, C and D. Denoting these sounds respectively by A, B, C and D, they can be converted from left channel and right channel stereophonic signal inputs L and R which are produced such as to satisfy equations $$L = \alpha A + \beta B - \beta C + \alpha D,$$

and $$R = \alpha B + \beta A - \beta D + \alpha C,$$

where $\alpha$ and $\beta$ are treated as constants that can be varied as functions of the frequency of these signals.

In other words, according to the invention with left channel and right channel signal inputs L and R ultimate sounds A, B, C and D are reproduced at four different spots.

Figure 2:
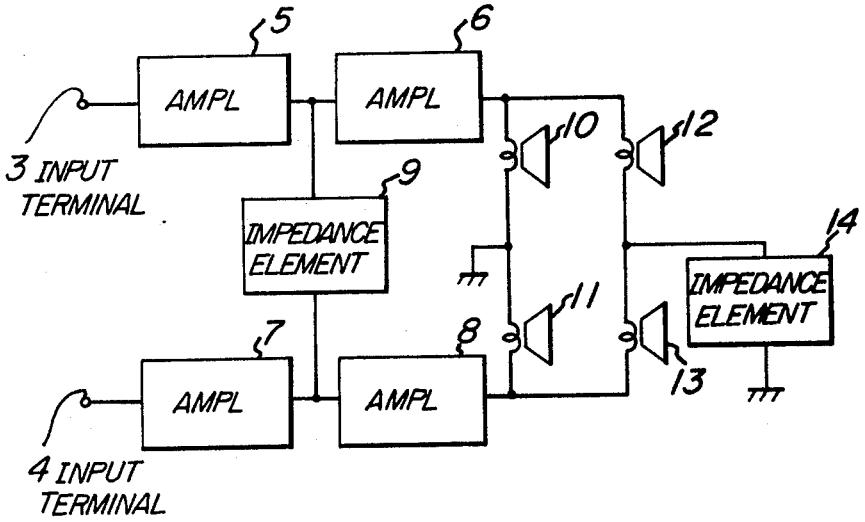
FIGS. 2 to 4 are block diagrams showing respective embodiments of the invention.

FIG. 2 shows a first embodiment of the stereophonic reproducing system according to the invention. It comprises input terminals 3 and 4 to receive respective left channel and right channel input signals, amplifiers 5 and 6 to amplify the left channel signal, amplifiers 7 and 8 to amplify the right channel signal, an impedance element 9 connected between the output terminals of the amplifiers 5 and 7, speakers 10 and 11 having respective coils connected at one end to the output terminals of the respective amplifiers 6 and 8 and commonly connected at the other end to ground, and speakers 12 and 13 having respective coils connected at one end to the output terminals of the respective amplifiers 6 and 8 and commonly connected at the other end through an impedance element 14 to ground.

The impedances of the impedance elements 9 and 14 are determined by the constants $\alpha$ and $\beta$.

With the above construction, the left channel and right channel input signals added to the respective input terminals 3 and 4 are eventually coupled through the speakers 10, 11, 12 and 13 except for partial loss or leakage through the impedance elements 9 and 14. The sound levels $V_{10}$, $V_{11}$, $V_{12}$ and $V_{13}$ of the sounds produced by the respective speakers 10, 11, 12 and 13 are expressed respectively as $$V_{10} = \alpha L + \beta R = (\alpha^2 + \beta^2)A + 2\alpha\beta B + (\alpha^2 - \beta^2)D$$

$$V_{11} = \alpha R + \beta L = (\alpha^2 + \beta^2)B + 2\alpha\beta A + (\alpha^2 - \beta^2)C$$

$$V_{12} = \alpha L - \beta R = (\alpha^2 + \beta^2)D - 2\alpha\beta C + (\alpha^2 - \beta^2)A$$

and $$V_{13} = \alpha R - \beta L = (\alpha^2 + \beta^2)C - 2\alpha\beta D + (\alpha^2 - \beta^2)B$$

Figure 5:
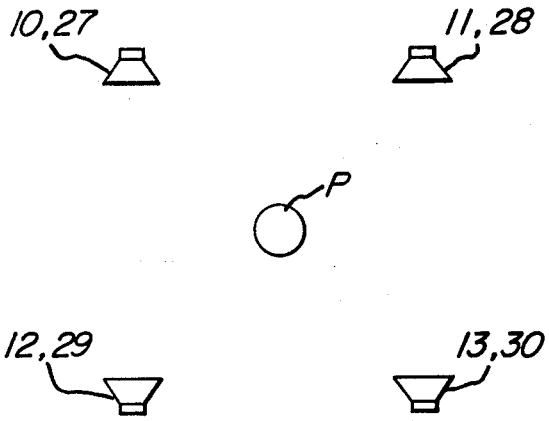
FIGS. 5 and 6 are schematic representations of the arrangement of the speakers in the stereophonic reproducing system according to the invention.

It will be appreciated that by appropriately selecting $\alpha$ and $\beta$, the second and third terms in the above equations may be made very small compared to the first term. By arranging the speakers 10, 11, 12 and 13 in adjacent corners of a rectangular room as shown in FIG. 5, the sounds *A, B, C* and *D* may be reproduced at proper levels with respect to position P.

Inasmuch as $\alpha$ and $\beta$ are real numbers, if $\alpha = \beta$, no left-from-right separation can be attained but only front-from-back separation is possible. On the other hand, if $\alpha = 0$ or $\beta = 0$, no front-from-back separation is possible but only left-from-right separation is possible. The impedance elements 9 and 14 may be adapted to be adjusted such that $\alpha$ and $\beta$ vary according to the reproduced frequency. By so doing, it is possible to have uniform acoustic effect all around the listening point P.

While the preceding embodiment has concerned with specifically producing the left and right channel input signals it can of course handle the usual 2-channel stereophonic signal as well.

Figure 3:
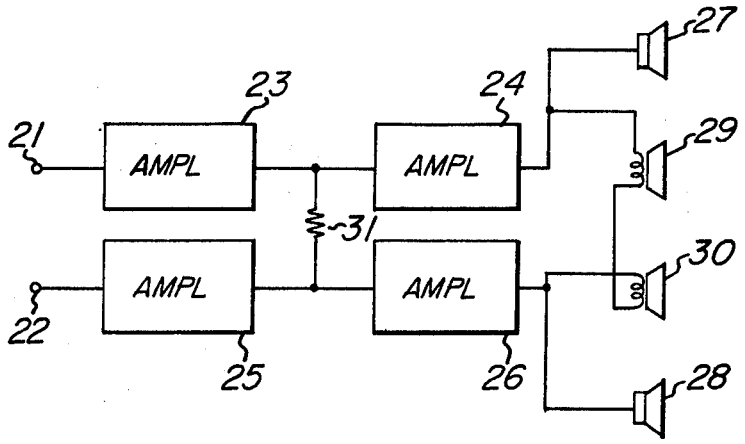

FIG. 3 shows a second embodiment of the invention. It comprises input terminals to receive left and right signals, amplifiers 23 and 24 to amplify the left channel signal, amplifiers 25 and 26 to amplify the right channel signal, front left and front right speakers 27 and 28 connected to the output terminals of the respective amplifiers 24 and 26, back left and back right speakers 29 and 30 connected between the output terminals of the amplifiers 24 and 26 for differential mode of operation, and an impedance element 31 having a comparatively large impedance connected between the output terminals of the amplifiers 23 and 25.

With the above construction, the left and right input signals are amplified through the amplifiers 23, 24, 25 and 26 before being coupled to the speakers 27, 28, 29 and 30. While the front left and front right speakers 27 and 28 receive outputs of the respective second-stage amplifiers 24 and 26 directly, the back left and back right speakers receive respective subtractive combinations of the right and left channel amplifier outputs. Thus, it is possible to obtain practically the same acoustic effects as are obtainable with 4-channel stereophonic reproducing systems. In the instant embodiment the impedance element 31 provides for partial leakage of the left signal to the right signal side and partial leakage of the right signal to the left signal side so that even when one of the signals becomes zero there is no possibility of causing large reverse current through transistors constituting the amplifiers. Thus, damage to the transistors may be prevented. Without any impedance present between the left and right channels, the output current in one channel directly flows in the reverse direction into the last-stage transistor of the other channel amplifier when the other channel input signal becomes zero. In such case, therefore, the last-stage transistor is likely to be damaged. In accordance with the instant embodiment, even when one channel input signal becomes zero, the other channel signal partly leaks to the first-said channel. In other words, at the last-stage transistor either channel signal never vanishes alone, so that destruction of the transistor can be completely prevented.

With the partial leakage of one channel signal through the impedance 31 to the other channel, the degradation of the separation degree as a whole is inevitable. However, the degradation may be minimized to a practically negligible extent by appropriately selecting the extent of leakage.

Figure 4:
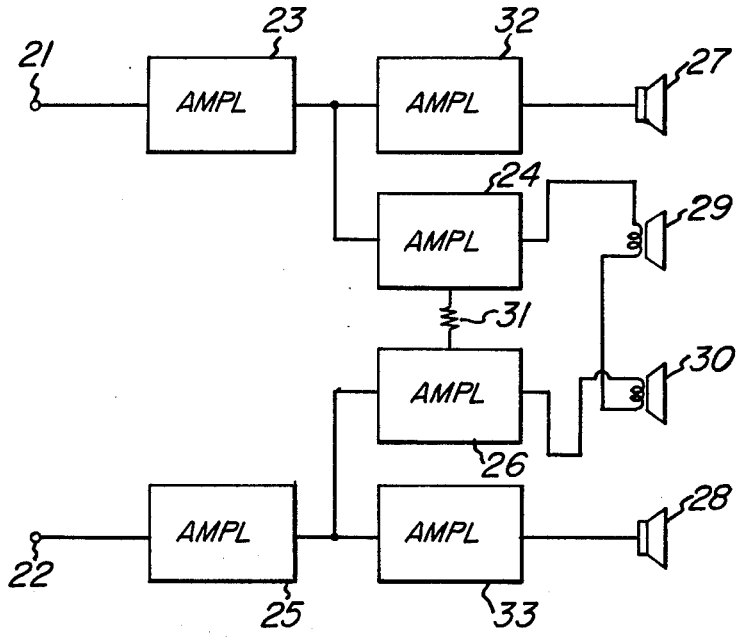

FIG. 4 shows modification of the preceding embodiment. While in the preceding embodiment the front left and front right speakers 27 and 28 are coupled to the same amplifying circuits as for the back left and back right speakers 29 and 30, in the instant embodiment the front left and front right speakers 27 and 28 are coupled to respective exclusive amplifiers 32 and 33. With this arrangement, the degradation of the separation degree can be completely eliminated.

Figure 6:
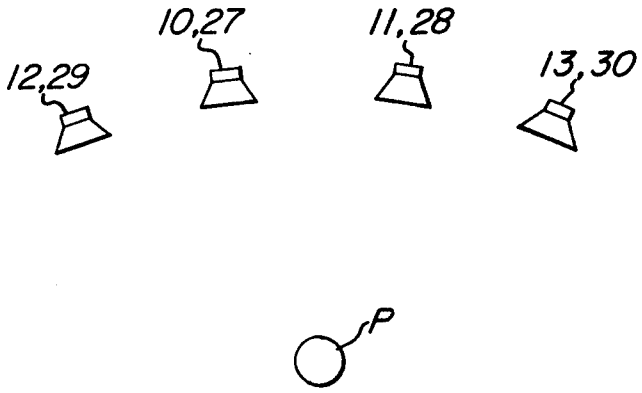

The arrangement of the speakers as shown in FIG. 5 is not limitative. FIG. 6, wherein the speakers 10, 27 and 11, 28 are positioned between speakers 12, 29 and 13, 30 along an arcuate line concave as viewed by a listener at P, shows a possible example of the arrangement of the speakers.

What is claimed is:

1. An audio reproduction system comprising:

left and right input terminals for receiving left and right signals respectively, left and right amplifiers having their inputs coupled to said left and right terminals respectively, front-left and rear-left amplifiers coupled to the output of said left amplifier, and front-right and rear-right amplifiers coupled to the output of said right amplifier, front-left and front-right speakers coupled to the outputs of said front-left and front-right amplifiers respectively, rear-left and rear-right speakers coupled in series between the outputs of said rear-left and rear-right amplifiers, a different one of said speakers being positioned approximately at each of the four corners of a quadrilateral area, which may be occupied by a listener, said speakers directing sound towards the interior of the area, wherein said front-left and front-right speakers are respectively positioned in the left and right front corners of the area behind the listener and said rear-left and rear-right speakers are positioned in the left and right rear corners of the area facing the listener, and an impedance element coupling said rear-left and rear-right amplifiers, the impedance of said impedance element having a substantial value capable of supplying partial leakage of a signal amplified by said rear-left amplifier to said rear-right amplifier and partial leakage of a signal amplified by said rear-right amplifier to said rear-left amplifier without degradation of the degree of separation between sound signals supplied to said front-left and front-right speakers, respectively.

* * * * *